US009739545B2

(12) United States Patent
Grassetti

(10) Patent No.: US 9,739,545 B2
(45) Date of Patent: Aug. 22, 2017

(54) METHOD FOR COATING A MECHANICAL MEMBER, AND MECHANICAL MEMBER THUS COATED

(71) Applicant: G.M.A. SRL, Staranzano (IT)

(72) Inventor: Roberto Grassetti, Monfalcone (IT)

(73) Assignee: G.M.A. SRL, Staranzano (IT)

( * ) Notice: Subject to any disclaimer, the term of this patent is extended or adjusted under 35 U.S.C. 154(b) by 271 days.

(21) Appl. No.: 14/719,718

(22) Filed: May 22, 2015

(65) Prior Publication Data

US 2015/0267975 A1 Sep. 24, 2015

Related U.S. Application Data

(62) Division of application No. 13/513,034, filed as application No. PCT/IB2010/003088 on Dec. 3, 2010, now Pat. No. 9,044,780.

(30) Foreign Application Priority Data

Dec. 4, 2009 (IT) ..... UD2009A0225

(51) Int. Cl.
*F28F 19/04* (2006.01)
*B05D 7/22* (2006.01)

(52) U.S. Cl.
CPC ..... *F28F 19/04* (2013.01); *B05D 7/22* (2013.01); *Y10T 428/24182* (2015.01)

(58) Field of Classification Search
CPC ..... Y10T 428/24182; F28F 19/04; B05D 7/22
USPC ..... 428/120
See application file for complete search history.

(56) References Cited

U.S. PATENT DOCUMENTS

| | | | |
|---|---|---|---|
| 3,448,804 | A | 6/1969 | Kreiselmaier |
| 4,795,662 | A | 1/1989 | Kreiselmaier |
| 5,820,931 | A | 10/1998 | Kreiselmaier |
| 2009/0129853 | A1 | 5/2009 | Pionetti |

FOREIGN PATENT DOCUMENTS

| | | |
|---|---|---|
| JP | 1-063899 | 4/1989 |

OTHER PUBLICATIONS

International Search Report & Written Opinion for PCT/IB2010/003088 mailed Feb. 10, 2012.

*Primary Examiner* — Alexander Thomas
(74) *Attorney, Agent, or Firm* — Flaster/Greenberg P.C.

(57) ABSTRACT

A method for coating a mechanical member provided with at least a support plate and one or more tubular elements attached in through manner to the support plate. The method comprises a first coating step, in which an external surface of the support plate is coated with a first layer of plastic material, and a second coating step in which a terminal portion of the internal surface of the tubular elements is coated with a multi-layer coating. In the second coating step the multi-layer coating is made by depositing in sequence one on top of the other a plurality of layers of plastic material, each of which is deposited partly in correspondence with the terminal portion of the internal surface of the relative tubular element and partly in correspondence with the surface of the first layer of the external surface of the support plate.

10 Claims, 3 Drawing Sheets

METHOD FOR COATING A MECHANICAL MEMBER, AND MECHANICAL MEMBER THUS COATED

CROSS-REFERENCE TO RELATED APPLICATIONS SECTION

This patent application claims priority under 35 U.S.C. §120 to and is a divisional application of previously filed U.S. patent application Ser. No. 13/513,034, filed May 31, 2012, now U.S. Pat. No. 9,044,780 entitled "Method for coating a mechanical member, and mechanical member thus coated," which claims priority to PCT/IB2010/003088 published in English, the entire disclosures of which are incorporated herein by reference.

BACKGROUND OF THE INVENTION

Field of the Invention

The present invention concerns a method for coating a mechanical member, for example to make an anti-wear coating on a tubing plate and at least on the internal terminal portion of the tubes associated therewith, so as to protect them from the corrosive action of galvanic currents, cavitation or other.

The present invention also concerns the mechanical member coated according to the method.

Description of the Related Art

It is known to coat at least partly some types of mechanical members, such as tubing plates and at least part of the internal portion of the tubes which form the bundle of tubes, in a fluidic plant, for example a conditioning or heat exchange plant or other. The coating is normally carried out to define a protection and/or a prevention against wear which normally occurs because of operative corrosions, for example galvanic corrosions, cavitation corrosions or other.

It is known to coat such plates and such tubes with layers formed by resins or plastic compounds, having a determinate elasticity, so as to prevent the direct contact of the fluids with the tubing plate or with the tubes, at least in correspondence with the critical zones of wear.

In particular, it is known to coat the external surface of the tubing plate with a single layer of plastic material.

It is also known to coat the terminal portion of the internal surface of the tubes in an independent way from the external surface of the tubing plate with a plurality of layers of plastic material, having different thicknesses and elasticity from the layer coating the plate.

It is also known to provide that the terminal layer of the coating of the internal surface of the tubes extends so as to be disposed over the coating of the tubing plate, so as to define a substantial surface continuity between the internal surface of the tube and the external surface of the tubing plate.

This known solution determines a difference in thickness of the outermost layer of the coatings formed, such as to entail a lack of uniformity with regard to the properties of resistance to wear, between the internal portion of the tubes and the external surface of the tubing plate.

In the state of the art, the layers of coating of the internal surface of the tubes, of which the outermost layer which extends as far as the tubing plate is also a part, have a degree of elasticity which is higher than the degree of elasticity of the coating of the external surface of the tubing plate.

This further increases the dis-uniformity of the resistance to wear of known coatings and, since they have different thicknesses, there is also a different mechanical behavior of the coating between the part disposed in correspondence with the terminal portions of the tubes and the part disposed on the external surface of the plate.

Therefore this type of known solution does not guarantee an efficient and lasting protection, or prevention from erosion of the tubing plate and the tubes, and can bring about mechanical and functioning failure of the mechanical member thus coated.

Document U.S. Pat. No. 5,820,931 is known, which describes a tubing plate coated with a plurality of layers inside the tubes, one on top of the other. In this known solution, the coating layers which are radially innermost are shorter than the outermost radial layers. And so, at the end of each layer, a plurality of steps form in rapid succession with respect to each other which disturb the flow of the fluid; furthermore, this happens in a zone where the fluid enters the tubes, where vorticity, cavitation and galvanic currents are very damaging for the mechanical structure of the tubing plate.

BRIEF SUMMARY OF THE INVENTION

Purpose of the present invention is to perfect a method, and make a relative mechanical member, which are both simple and economic to produce and which guarantee an efficient and long lasting protection, or prevention, from wear due to corrosion.

The Applicant has devised, tested and embodied the present invention to overcome the shortcomings of the state of the art and to obtain these and other purposes and advantages.

The present invention is set forth and characterized in the independent claims, while the dependent claims describe other characteristics of the invention or variants to the main inventive idea.

In accordance with the above purpose, a method according to the present invention is applied to coat a mechanical member provided with at least a support plate, or tubing plate, and one or more tubular elements attached in through manner to the support plate.

The method according to the present invention comprises at least a first coating step, in which an external surface of the support plate is coated with a first layer of plastic material, and a second coating step in which at least a terminal portion of the internal surface of the tubular elements in substantial correspondence with the support plate is coated with a plurality of layers of plastic material.

According to the present invention, the second coating step provides that the layers of plastic material are deposited one on top of the other in sequence, and that each of these is disposed partly in correspondence with the relative terminal portion of the internal surface of the tubular element and partly in correspondence with the surface of the coating layer of the external surface of the support plate.

In this way, the overlapping layers define a surface and structural continuity of the internal surface of the tubular element and the external surface of the support plate, substantially without any break in continuity.

This feature, as well as improving the fluidic and functional conditions of the mechanical member, guarantees a uniformity of resistance and prevention from wear both along the terminal portion of the tubular elements and also on the external surface of the plate.

Moreover, by providing that each of the layers deposited in the second coating step extends both in correspondence with the terminal portion of the internal surface of the tubular element, and also in correspondence with the surface of the plate, it allows to define an external coating which is common both to the tubular elements and to the plate, which common coating has a constant thickness and, therefore, the same mechanical and functional properties. Moreover, according to the present invention, the method provides to deposit in sequence a first layer of said layers on to the internal surface of each of said tubular elements in a more external position radially with respect to a longitudinal axis of the tubular element, and to deposit onto said first layer at least a second layer of said layers radially internal with respect to the axis of the tubular elements.

The first layer is made inside the tubular element substantially parallel to the axis for a first length which is from about one to about two times the nominal diameter of the tubular element.

The second layer is made inside the tubular element substantially parallel to the axis for a second length which is greater than the first length by a segment which is from about one to about two times the nominal diameter of the tubular element, defining a first internal diameter, less than the nominal diameter and substantially constant for the first length of the first layer and at least a second internal diameter, less than the nominal diameter and greater than the first diameter, substantially constant for the segment of the second length beyond which the second layer extends with respect to the first layer. According to a variant, the extension segment of the at least one second layer is made directly on the internal surface of each of the tubular elements.

The coating of the tubular elements thus obtained astride the tubing plate increases its mechanical resistance to phenomena of corrosion and cavitation.

Moreover, the method is more economical than the state of the art, in that it defines a greater internal thickness of the tube only in the zones which are more affected by problems of corrosion and cavitation, that is, in correspondence with the entrance of the fluid into the tubular elements, while, as the layers gradually extend inside the tubular elements, their thickness diminishes, because it is not as necessary as in the zone where the fluid enters.

Advantageously, the sequential reduction of thickness inside the tube, from the entrance zone of the fluid toward the inside, is fluid-dynamically correlated to the nominal diameter of the tubular elements.

In this way, moreover, the steps which form at the end of each layer with respect to the immediately preceding layer, with the present invention are distanced from the zone of turbulence caused by the entrance of the fluid into the tubular elements toward the inside of the tubular elements, where the flow of fluid stabilizes more, contributing to reduce voracity and therefore damage from cavitation, in the entrance zone.

In this way, a progressive increase in the thickness of the coating inside the tubular element is defined, from the internal zone of the tubular element to the end, substantially following the increase in intensity of the possible causes of wear.

A further form of embodiment provides to deposit at least a third layer of the layers more internally with respect to the at least one second layer radially with respect to the axis; the third layer is made inside the tubular element substantially parallel to the axis of the tubular elements for a third length which is greater than the second length by a segment which is from about one to about two times the nominal diameter of the tubular element, so as to define at least a third internal diameter, less than the nominal diameter and greater than the second diameter, substantially constant for the segment of the third length beyond which the third layer extends with respect to the second layer.

According to a variant, the extension segment of the at least one third layer is made directly on the internal surface of each of the tubular elements.

A possible fourth, fifth or other layers are always disposed with a length inside the tubular element progressively bigger than the length of the preceding layer.

Overall, once the layers are deposited, the internal section of the tubular element is tapered off toward the outside.

This variant solution allows to reduce to a minimum the risk of cavitations inside the terminal part of the tubular element.

According to another variant, during the first coating step, a preparation sub-step is provided, in which relative closing caps are disposed on the support plate, in particular inside its through holes provided for positioning the tubular elements.

The caps are conformed, at least partly, substantially as a truncated cone, so that once the first layer of plastic material has been disposed on the external surface of the support plate, this layer has a flared conformation in correspondence with the through holes.

The flaring thus defined allows to improve the functional conditions of the mechanical member once it has been coated, also reducing the risk of cavitation.

According to a variant, the first layer which coats the external surface of the support plate comprises a plastic material with a solvent-free, epoxy based resin, advantageously with inert matter, in order to increase its density.

According to another variant, each layer of coating of the terminal portion of the internal surface of the tubular element comprises a plastic material based on an epoxy based resin with added amines.

According to another variant, the plastic material which makes up the coating of the external surface of the support plate has a higher ultimate elongation, advantageously lower than 2%, than the material which makes up each coating layer of the terminal portion of the internal surface of the tubular element.

In accordance with one form of embodiment of the present invention, both the support plate and, in particular, the tubular elements, are subjected, upstream of the first and second coating step, to a surface treatment operation, such as sandblasting, by means of which the surface is cleaned and a surface roughness is made onto which the coating materials, gradually applied and deposited, can advantageously grip so as to obtain a good stability of the final coating.

The present invention also concerns a mechanical member, provided with at least a support plate and one or more tubular elements attached in through manner to the support plate, in which an external surface of the support plate is coated with a first layer of plastic material, and in which at least a terminal portion of the internal surface of each of the tubular elements, in substantial correspondence with the support plate, is coated with a multi-layer coating which comprises a plurality of layers of plastic material disposed in sequence one on top of the other, each of the layers being deposited partly in correspondence with the terminal portion of the internal surface of the relative tubular element and partly in correspondence with the surface of the first layer of the external surface of the support plate.

According to the present invention, a first layer of the layers is disposed on the internal surface of each of the tubular elements in a more external radial position with respect to a longitudinal axis of the tubular element and at least a second layer of the layers is disposed radially internal with respect to the axis of the tubular elements on the first layer.

The first layer extends inside the tubular element substantially parallel to the axis for a first length which is from about one to about two times the nominal diameter of the tubular element and the second layer extends inside the tubular element substantially parallel to the axis of the tubular elements for a second length which is greater than the first length by a segment which is from about one to about two times the nominal diameter of the tubular element, so as to define a first internal diameter, less than the nominal diameter and substantially constant for the first length of the first layer and at least a second internal diameter, less than the nominal diameter and greater than the first diameter, substantially constant for the segment of the second length beyond which the second layer extends with respect to the first layer.

In some forms of embodiment, the extension segment of the at least one second layer is disposed directly on the internal surface of each of the tubular elements.

In some forms of embodiment the mechanical member of the present invention provides at least a third layer of the layers disposed more internally radially with respect to the axis which extends inside the tubular element substantially parallel to the axis for a third length which is greater than the second length by a segment which is from about one to about two times the nominal diameter of the tubular element, so as to define at least a third internal diameter, less than the nominal diameter and greater than the second diameter, substantially constant for the segment of the third length beyond which the third layer extends with respect to the second layer.

In some forms of embodiment the extension segment of the at least one third layer is disposed directly on the internal surface of each of the tubular elements.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

Figure 1:
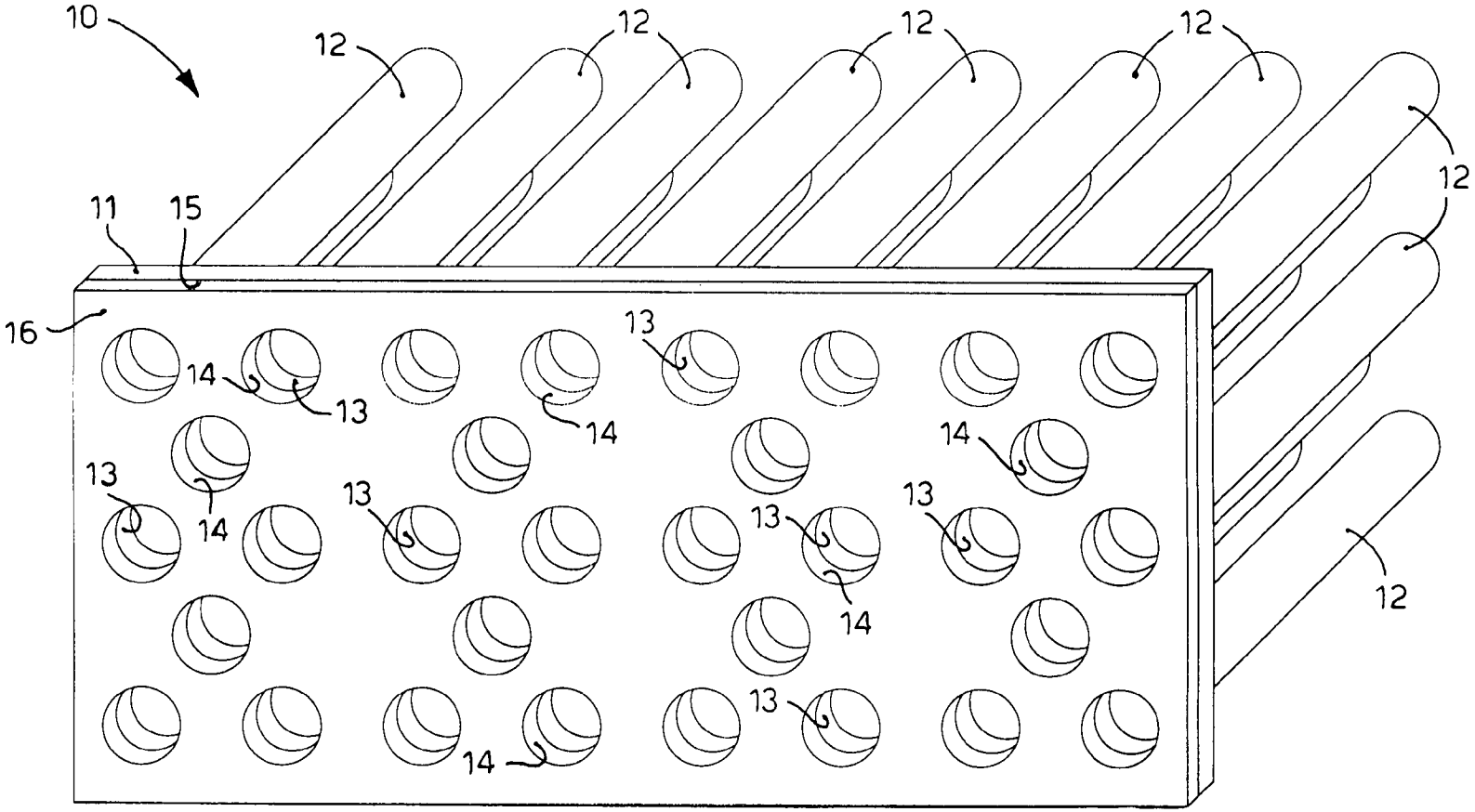
FIG. 1 shows a three-dimensional view of part of a mechanical member coated using the method according to the present invention.

To facilitate comprehension, the same reference numbers have been used, where possible, to identify common elements in the drawings that are substantially identical. It is understood that elements and characteristics of one form of embodiment can conveniently be incorporated into other forms of embodiment without further clarifications.

DETAILED DESCRIPTION OF THE INVENTION

With reference to the attached drawings a mechanical member 10 is partially shown, in this case consisting substantially of a tubing plate 11 and a plurality of tubes 12, or bundle of tubes, normally used in fluidic conditioning or heat exchange plants or other.

In particular, the tubing plate 11 has a substantially parallelepiped shape and comprises a plurality of through holes 13 made in a determinate pattern. Each tube 12 is inserted in correspondence with a relative through hole 13, so as to allow a fluid to pass, such as water or other heat-carrying liquid, typically used in such plants.

The tubing plate 11 comprises at least an external surface 15, opposite the side on which the tubes 12 are associated with the holes 13.

The external surface 15 is coated with a coating layer 16 of solvent-less resin with an epoxy base, and in this case also comprising special inert matter which characterizes the density and the resistance both to wear and impact.

The application of this material also confers high insulating qualities to the tubing plate 11.

The coating layer 16 has a thickness comprised between about 2 mm up to more than 10 mm, advantageously between about 3 mm and about 5 mm.

Moreover, the coating layer 16 has a flared mouth 14, in correspondence with each through hole 13.

In this case, the coating layer 16 is conformed so as to also contact the external end surface of each tube 12 associated with the relative through hole 13.

Figure 2:
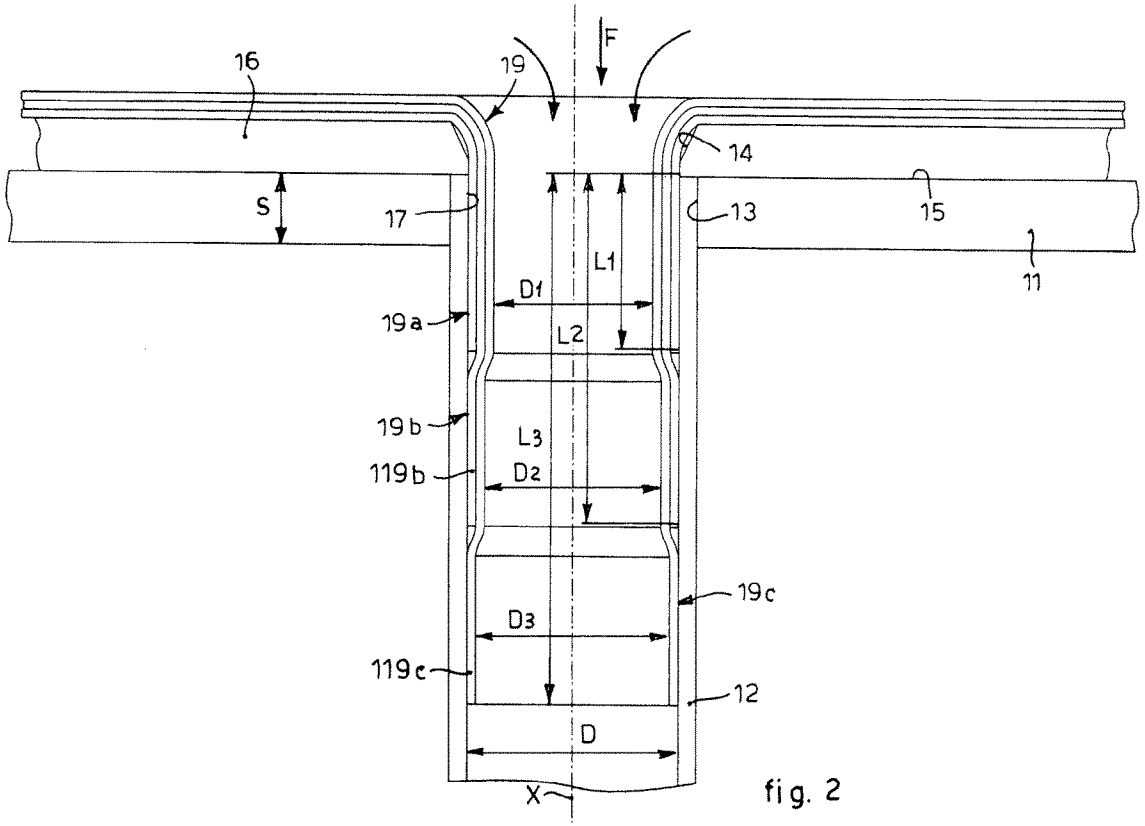
FIG. 2 shows an enlarged and sectioned detail of the mechanical member in FIG. 1.

Each tube 12 has a cylindrical internal surface 17, inside which the heat-carrying fluid of the plant is able to flow, in the direction indicated by the arrow F in FIG. 2.

The internal cylindrical surface 17 of each tube 12 is coated at least in correspondence with one of its terminal portions near the through hole 13.

According to the invention, the coating of the internal cylindrical surface 17 also extends continuously on an external surface of the coating layer 16 of the tubing plate 11.

In this way, a substantial surface and structural continuity is defined of the coatings provided for the tubing plate 11 and for the relative tubes 12. Moreover, the coating of the internal cylindrical surface 17 defines a thickening of the tube 12 astride the thickness S of the tubing plate 11, increasing the mechanical resistance in this zone which is subject to phenomena of corrosion by galvanic currents and cavitations deriving from the voracity of the entering flow.

In particular, the internal cylindrical surface provides a multi-layer coating 19, in this case defined by three layers, respectively first 19*a*, second 19*b* and third 19*c*, one on top of the other.

Each of the three layers 19*a*, 19*b* and 19*c* is made with a solvent-less resin with an epoxy base and with added amines.

The resin has particular properties of resistance over time to mineral acids, diluted organic acids, alkalis with a high concentration of solvents and hydrocarbons, and has a field of action PH 1-14.

Each layer 19*a*, 19*b* and 19*c* has a thickness comprised between about 0.15 mm and about 0.25 mm and extends according to different lengths along the tube 12, in order to define a desired configuration.

In FIG. 2, in which a section of the connection zone between tube 12 and tubing plate 11 is shown, for convenience of representation the lengths of the three layers 19*a*, 19*b* and 19*c* are in proportion to each other, but not in proportion with respect to other details shown.

In particular, a first layer 19*a* is disposed on the internal surface 17 of each of the tubes 12 in a more external position radially with respect to a longitudinal axis X of the tubular element 12 and at least a second layer 19*b* is disposed internally radially with respect to the axis on the first layer.

The first layer 19*a* extends inside the tube 12 substantially parallel to the axis X for a first length L1 which is from about one to about two times the nominal diameter D of the tube 12 and the second layer 19*b* extends inside the tube 12 substantially parallel to the axis X for a second length L2 which is greater than the first length L1 by a segment 119*b* which is from about one to about two times the nominal diameter D of the tubular element 12, so as to define a first internal diameter D1, less than the nominal diameter D and substantially constant for the first length L1 of the first layer 19*a* and at least a second internal diameter D2, less than the nominal diameter D and greater than the first diameter D1, substantially constant for the segment 119*b* of the second length L2 beyond which the second layer 19*b* extends with respect to the first layer 19*a*.

In the form of embodiment shown, the segment 119*b*, the length of which is given by the difference between the lengths L2 and L1, is disposed directly on the internal surface 17 of each of the tubular elements 12.

Moreover, according to one form of embodiment of the present invention, at least a third layer 19*c* is disposed more internally radially with respect to the axis X and extends inside the tube 12 substantially parallel to the axis X for a third length L3 which is greater than the second length L2 by a segment 119*c* which is from about one to two times the nominal diameter D of the tube 12, so as to define at least a third internal diameter D3, less than the nominal diameter D and greater than the second diameter D2, substantially constant for the segment 119*c* of the third length L3 beyond which the third layer 19*c* extends with respect to the second layer 19*b*.

In the form of embodiment shown, the segment 119*c*, the length of which is given by the difference between the lengths L3 and L2, is disposed directly on the internal surface 17 of each of the tubes 12.

The reduction in diameter, with respect to the nominal diameter D of the tube 12, in correspondence with the first layer 19*a* and the segments 119*b* and 119*c*, is given by the sum of the thicknesses of the layers 19*a*, 19*b*, 19*c* which on each occasion radially overlap along the tube 12, thus defining the diameters D1, D2, D3. Therefore the diameter D1 in correspondence with the entrance zone of the fluid, the direction of the flow of which is shown by the arrow F in FIG. 2, and astride the tubing plate 11, the thickness of which is shown by the letter S, is smaller because the thickness of the multi-layer coating 19, given by the sum of the thicknesses of all the layers 19*a*, 19*b*, 19*c*, is greater. The diameter D2 is greater than the diameter D1 because, in correspondence with the segment 119*b*, there are only two layers overlapping radially, 19*b* and 19*c*, the sum of their thicknesses determining the diameter D2. The diameter D3 is, in its turn, greater than the diameter D2, because in correspondence with the segment 119*c* only the layer 19*c* is provided, the thickness of which determines the diameter D3.

In some forms of embodiment, the first layer 19*a* extends inside the tube 12 for a length L1 comprised between about 50 mm and about 100 mm, the second layer 19*b* is disposed above the first layer 19*a* and extends for a length L2 comprised between about 150 mm and about 200 mm, while the third layer 19*c* is disposed above the second layer 19*b* and extends for a length L3 comprised between about 250 mm and about 300 mm. In general, each layer 19*a*, 19*b* and 19*c* extends for a relative length L1, L2 and L3, such that they overlap by at least about 20 mm above the layer 19*a*, 19*b* below.

In this way, a usable passage section is defined inside the tube 12, which section is tapered off toward the exit of the tube, in order to promote the fluidic conditions of use.

The method according to the present invention to coat the mechanical member 10 as described heretofore is as follows, and refers to the operating sequence shown schematically in FIGS. 3 to 8.

Initially, the inside of the tubes 12 are washed and finished, so as to prepare at least the internal cylindrical surface 17 for coating.

Advantageously, both the tubing plate 11, and the tubes 12 are subjected, before coating, to a surface treatment which both performs a surface cleaning of impurities and also produces a desired surface roughness of the material, in order to promote the grip of the coating material. In some forms of embodiment, the roughness which is made on the tubing plate 11 is in the range of about 80 microns, while the roughness made inside the tube 12 is in the range of about 20-25 microns.

Figure 3:
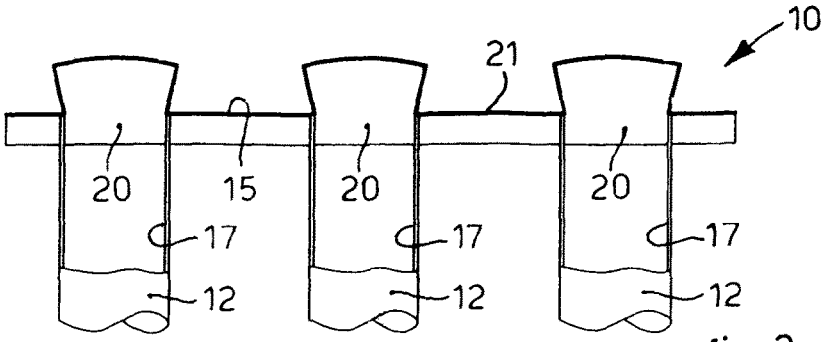
FIG. 3 shows a first operating condition of the method according to the present invention.
Figure 4:
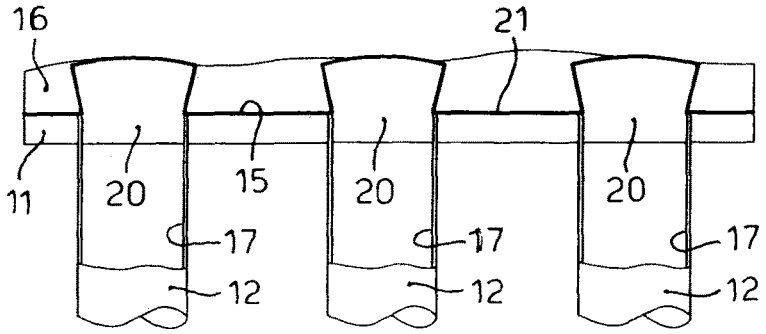
FIG. 4 shows a second operating condition of the method according to the present invention.
Figure 5:
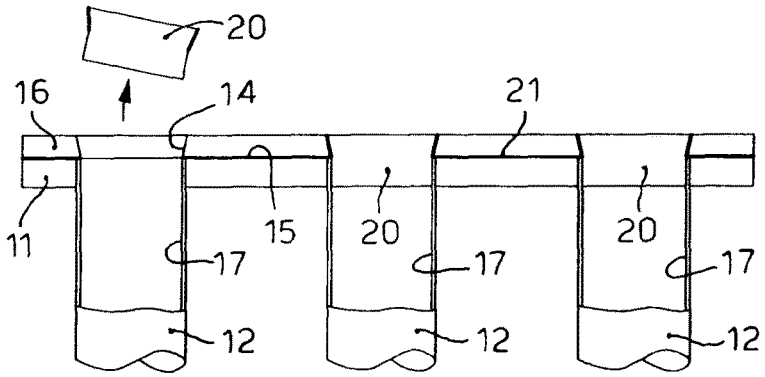
FIG. 5 shows a third operating condition of the method according to the present invention.

With reference to FIG. 3, inside the end of the tubes 12, on the side where the connection with the through holes 13 of the tubing plate 11 occurs, a plurality of caps 20 are disposed, for example made of non-stick material.

Each cap 20 has a flared conformation so as to define, subsequently, the flared mouth 14 of the coating layer 16 in correspondence with the through holes 13 of the tubing plate 11.

A layer of primer 21, or other similar compound, is subsequently deposited on the external surface 15 of the tubing plate 11, which improves the adhesive conditions of the coating layer 16 which is subsequently deposited.

The layer of primer 21 is deposited so as to completely recover the tubing plate 11 and all the interstices between cap 20 and cap 20.

Once the catalysis of the layer of primer 21 has occurred, the plastic material that makes up the coating layer 16 is applied, for example by spatula.

Once the plastic material of the coating layer 16 has dried, the coating layer 16 is smoothed, taking away any excess material in order to uncover the heads of the caps 20 below.

Subsequently, the caps 20 are removed and the mechanical member 10 is cleaned of any working residues and/or surplus material used for the coating of the external surface 15 of the tubing plate 11.

Advantageously, a layer of epoxy resin is applied on top of the coating layer as protection.

Figure 6:
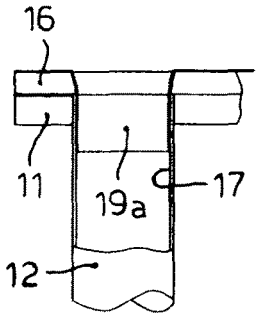
FIG. 6 shows a fourth operating condition of the method according to the present invention.
Figure 7:
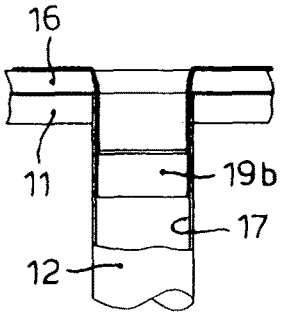
FIG. 7 shows a fifth operating condition of the method according to the present invention.
Figure 8:
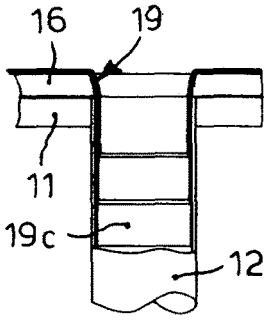
FIG. 8 shows a sixth operating condition of the method according to the present invention.

As shown in sequence in FIGS. 6, 7 and 8, the three layers 19*a*, 19*b* and 19*c* are deposited one on top of the other, in order to define the multi-layer coating 19, as described above.

Each layer 19*a*, 19*b* and 19*c* is advantageously applied by means of a spray gun with a radial spray, so as to form a uniform protective layer on the corresponding portion of the internal cylindrical surface 17.

It is clear that modifications and/or additions of steps or parts may be made to the mechanical member 10 as described heretofore, without departing from the field and scope of the present invention.

For example, it comes within the field of the present invention to provide that the multi-layer coating 19 can consist of a number of layers other than three, for example two, four or more, depending on the operating conditions of the mechanical member 10 and/or other determinate factors.

It is also clear that, although the present invention has been described with reference to some specific examples, a person of skill in the art shall certainly be able to achieve many other equivalent forms of method for coating a mechanical member and mechanical member thus coated, having the characteristics as set forth in the claims and hence all coming within the field of protection defined thereby.

I claim:

1. A mechanical member provided with at least a support plate and one or more tubular elements attached in through manner to said support plate, in which an external surface of said support plate is coated with a first layer of plastic material, and in which at least a terminal portion of the internal surface of each of said tubular elements, in substantial correspondence with the support plate, is coated with a multi-layer coating which comprises a plurality of layers of plastic material disposed in sequence one on top of the other, each of said layers being deposited partly in correspondence with said terminal portion of the internal surface of the relative tubular element and partly in correspondence with the surface of said first layer of the external surface of said support plate, wherein a first layer of said layers is disposed on the internal surface of each of said tubular elements in a more external position radially with respect to a longitudinal axis of the tubular element and at least a second layer of said layers is disposed internal radially with respect to the axis on said first layer, in which said first layer extends inside said tubular element substantially parallel to said axis for a first length which is from about one to about two times the nominal diameter of said tubular element and said second layer extends inside said tubular element substantially parallel to said axis for a second length which is greater than said first length by a segment which is from about one to about two times the nominal diameter of said tubular element, so as to define a first internal diameter, less than said nominal diameter and substantially constant for the first length of said first layer and at least a second internal diameter, less than said nominal diameter and greater than said first diameter, substantially constant for the segment of the second length beyond which the second layer extends with respect to the first layer.

2. The mechanical member as in claim 1, wherein said segment of said at least one second layer is disposed directly on said internal surface of each of said tubular elements.

3. The mechanical member as in claim 2, wherein at least a third layer of said layers is disposed more internally radially with respect to the axis which extends inside said tubular element substantially parallel to said axis for a third length which is greater than said second length by a segment which is from about one to about two times the nominal diameter of said tubular element so as to define at least a third internal diameter, less than said nominal diameter and greater than said second diameter, substantially constant for the segment of the third length beyond which the third layer extends with respect to the second layer.

4. The mechanical member as in claim 3, wherein said segment of said at least one third layer is disposed directly on said internal surface of each of said tubular elements.

5. The mechanical member as in claim 1, wherein at least a third layer of said layers is disposed more internally radially with respect to the axis which extends inside said tubular element substantially parallel to said axis for a third length which is greater than said second length by a segment which is from about one to about two times the nominal diameter of said tubular element so as to define at least a third internal diameter, less than said nominal diameter and greater than said second diameter, substantially constant for the segment of the third length beyond which the third layer extends with respect to the second layer.

6. The mechanical member as in claim 5, wherein said segment of said at least one third layer is disposed directly on said internal surface of each of said tubular elements.

7. The mechanical member as in claim 1, wherein the first coating layer of the external surface of the support plate comprises a plastic material based on a solventless resin with an epoxy base.

8. The mechanical member as in claim 7, wherein the solventless resin with an epoxy base of the first layer comprises a determinate quantity of inert matter to increase a density of the solventless resin.

9. The mechanical member as in claim 1, wherein each layer of the multi-layer coating of the terminal portion of the internal surface of the tubular elements comprises a plastic material based on a resin with an epoxy base with added amines.

10. The mechanical member as in claim 1, wherein the plastic material comprised within the first coating layer of the external surface of the support plate has an ultimate elongation value higher than an ultimate elongation value of the plastic material in each layer of the multi-layer coating of the terminal portion of the internal surface of the tubular elements.

* * * * *